United States Patent [19]

Hall

[11] Patent Number: 4,503,318

[45] **Date of Patent: * Mar. 5, 1985**

[54] APPARATUS FOR THE SPARK PERFORATION OF SHEET MATERIALS

[75] Inventor: Robert J. Hall, Flackwell Heath, Nr. High Wycombe, England

[73] Assignee: Wiggins Teape Group Limited, England

[ * ] Notice: The portion of the term of this patent subsequent to Oct. 19, 1999 has been disclaimed.

[21] Appl. No.: 426,228

[22] Filed: Sep. 28, 1982

Related U.S. Application Data

[63] Continuation of Ser. No. 279,210, Jun. 30, 1981, Pat. No. 4,355,226.

[30] Foreign Application Priority Data

Jul. 8, 1980 [GB] United Kingdom ..... 8022239

[51] Int. Cl.[3] ..... H05B 7/18

[52] U.S. Cl. ..... 219/384; 83/16; 162/114; 162/192; 315/35

[58] Field of Search ..... 219/383, 384, 68, 69 R, 219/121 EH; 346/162, 163, ; 83/16, 170, 177, 365; 315/35; 131/281; 162/114, 192, 204, 207, 286

[56] References Cited

U.S. PATENT DOCUMENTS

| | | | |
|---|---|---|---|
| 2,763,759 | 9/1956 | Mito et al. | 219/384 |
| 3,351,740 | 11/1967 | Heuer | 219/384 |
| 3,424,895 | 1/1969 | Olson | 219/384 |
| 3,538,308 | 11/1970 | Schmidt | 219/384 |
| 3,571,952 | 3/1971 | Schmidt et al. | 219/384 |
| 3,582,985 | 6/1971 | Farneth | 219/384 |
| 3,862,396 | 1/1975 | Machida et al. | 219/384 |
| 4,219,727 | 9/1980 | Bolt | 131/281 |
| 4,236,062 | 11/1980 | Lilly, Jr. et al. | 219/384 |
| 4,278,871 | 7/1981 | Schmidt-Kufeke et al. | 219/384 |
| 4,287,525 | 9/1981 | Tagawa | 346/162 |
| 4,355,226 | 10/1982 | Hall | 219/384 |

FOREIGN PATENT DOCUMENTS

| | | | |
|---|---|---|---|
| 1255930 | 12/1971 | United Kingdom | 219/69 M |

*Primary Examiner*—Roy N. Envall, Jr.
*Assistant Examiner*—Geoffrey S. Evans
*Attorney, Agent, or Firm*—Burns, Doane, Swecker & Mathis

[57] ABSTRACT

Apparatus for spark perforation of sheet material comprising spaced apart first and second electrodes which define between them a sparking zone through which sheet material to be perforated can be moved in a predetermined direction, and in which the portion of the first electrode which is nearest to the nearest portion of the second electrode is located between an overlap position upstream of the second electrode in the direction of movement of the sheet by a distance of 1 mm and an offset position also equal to 1 mm in the direction of movement of the sheet, and means for guiding the sheet through the sparking zone along a path closer to said second electrode than said first electrode.

19 Claims, 28 Drawing Figures

Y
·75
·5
·25
1·0
·75
·5
·25
0·0
0·25
0·5
0·75
1·0
X
F
D
E
B
J
J
J
3

FIG.10
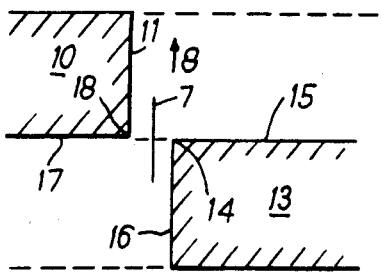
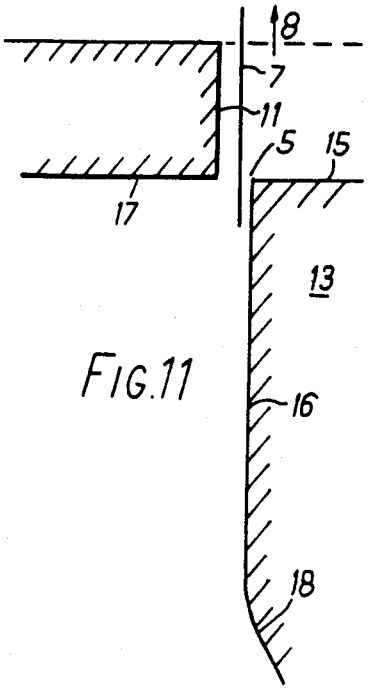
FIG.11
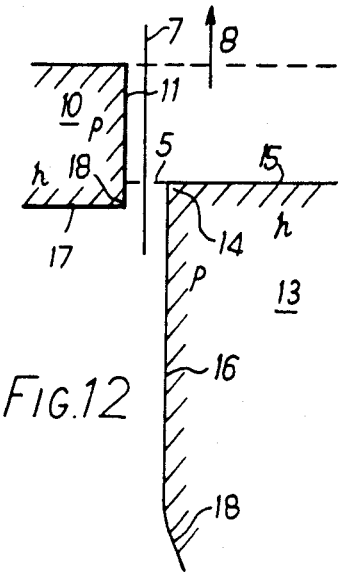
FIG.12
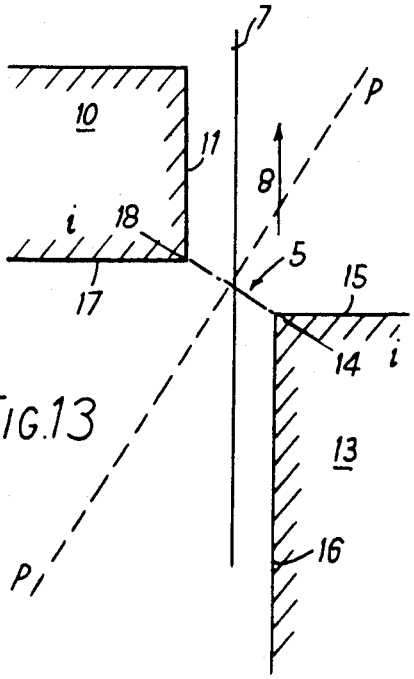
FIG.13

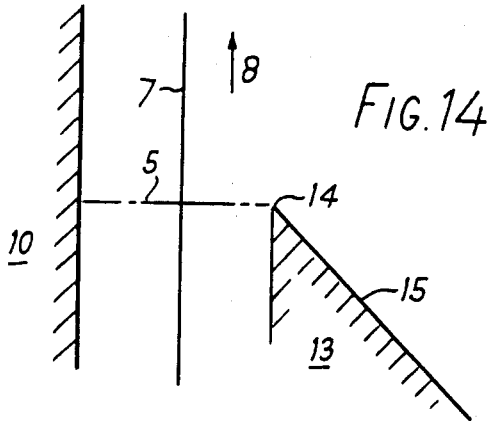
FIG. 14
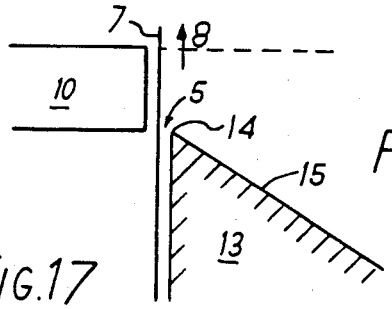
FIG. 16
FIG. 17
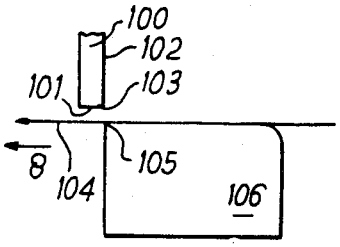
FIG. 18
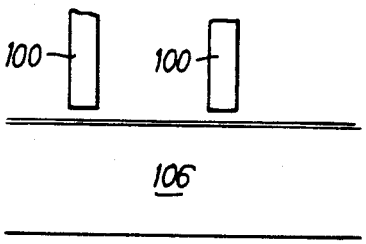
FIG. 19
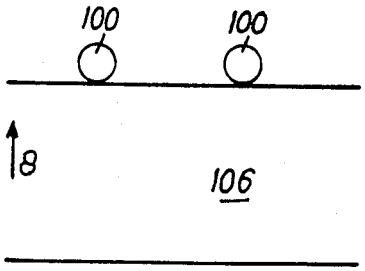

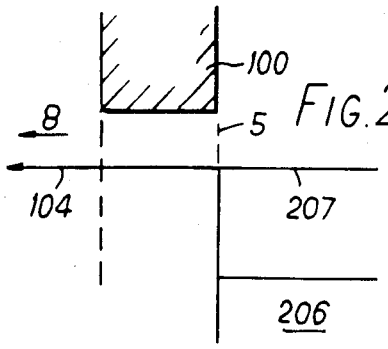
FIG. 20
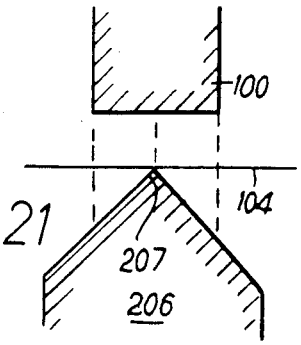
FIG. 21
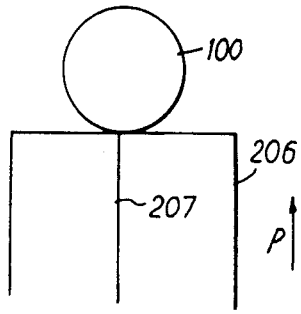
FIG. 22
FIG. 23
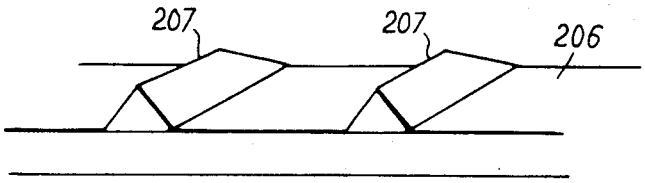
FIG. 24
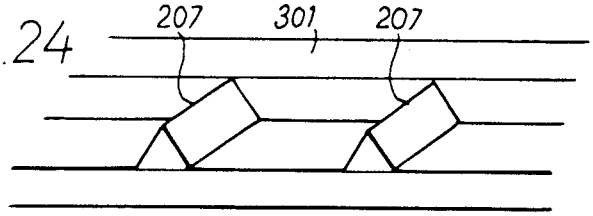
FIG. 25
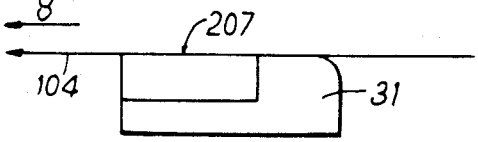

APPARATUS FOR THE SPARK PERFORATION OF SHEET MATERIALS

This application is a continuation of application Ser. No. 279,210, filed June 30, 1981, now U.S. Pat. No. 4,355,226.

This invention relates to apparatus for the spark perforation of sheet materials, and in particular to the configuration and arrangement of electrodes for use in such apparatus.

Spark perforation is a technique used to form rows of small holes at a fine pitch in a moving sheet, for example paper such as cigarette tissue, in which an enhancement in permeability is required.

Known apparatus embodies pairs of opposed needle pointed electrodes between which the sheet material is drawn whilst sparks are struck. With such an arrangement, because of electrode erosion, the gaps must frequently be adjusted within narrow tolerances to achieve satisfactory spark propagation. A further drawback lies in the need to provide accurate guidance and tension control for the sheet to prevent the needles from causing physical damage.

However, the main problem encountered with the use of needle electrodes lies in their tendency to promote spark "drag-out". This effect occurs as a result of the character of the stress gradient which exists in the gap between the electrodes. As a spark is generated and ruptures the paper, an ionized air channel of higher conductivity is produced along the path of the spark and through the hole produced in the paper. As the paper continues to move, the stress gradient between the electrodes permits the spark to be sustained for a time over a lengthening arc through the hole. The effect of this is an enlargement of the hole beyond the desired diameter and the prevention of generation of another spark to form the next hole at the desired pitch.

To overcome this problem, it has been proposed to utilize discrete electrical pulses to generate the sparks in an endeavour to obtain a small hole pitch. However, due to the existence of the ionized air channel of higher conductivity in combination with the particular stress gradient existing in the electrode gap, the second spark tends to track through the existing hole in preference to producing a new hole in the sheet.

It is among the objects of the present invention to provide a configuration and arrangement of electrodes for effecting spark perforation in which spark drag out is substantially reduced and in which the other problems associated with the use of needle electrodes are minimized.

According to the present invention apparatus for spark perforation of sheet material comprises spaced apart first and second electrodes which define between them a sparking zone through which sheet material to be perforated can be moved in a predetermined direction, and in which the portion of the first electrode which is nearest to the nearest portion of the second electrode is located between an overlap position upstream of the second electrode in the direction of movement of the sheet by a distance of 1 mm and an offset position also equal to 1 mm in the direction of movement of the sheet, and means for guiding the sheet through the sparking zone along a path closer to said second electrode then first electrode.

Preferably the gap between the electrodes is between 0.2 and 1.0 mm

Conveniently the portion of each electrode which is nearest to the other electrode is in the form of a corner, the corner on the first electrode being formed between a side surface or edge, and an end surface or edge extending away from the corner in the direction of movement of the sheet.

The corner on the second electrode which is formed between a side surface or edge and a converging end surface or edge may be arranged to extend away from said corner in the opposite direction to the direction of movement of the sheet.

The enclosed angle at the corner of the first electrode can be between the side surface or edge and the end surface or edge between approximately 60° and 120° and preferably the enclosed angle is between 80° and 95°.

The enclosed angle at the corner of the second electrode between the side surface or edge and the end surface or edge can be between approximately 45° and 120° and preferably the enclosed angle is between 80° and 95°.

The electrode can be mounted for longitudinal or vertical movement of the sheet as desired.

The said first electrode may be in the form of a pin-like member the corner being formed at its lower end, and the second electrode can be formed as a bar-like member, the corner being provided at an end surface or edge at one of its long sides.

The apparatus may include a number of sets of spaced apart electrodes and thus the said first electrodes can be arranged in a row or rows, transverse to the direction of movement of the sheet.

With this arrangement the bar-like member can be arranged to act as a support bar for the sheet and extends along the length of the row.

In the arrangement set forth above the longitudinally extending edges can be formed as a series of apexed ridges on the support bar, the ridges extending in the direction of movement of the sheet towards the corner provided on each.

In order to assist feed of the sheet a lead-on bar can be provided which extends transversely to the direction of movement of the sheet and which joins the ridges and acts to guide the sheet onto the edges.

In order to remove debris and hold the paper down onto the second electrode a vacuum may be provided to the underside of the sheet downstream of the second electrode.

The invention can be performed in many ways and some embodiments will now be described by way of example and with reference to the accompanying drawings in which.

Figure 2:
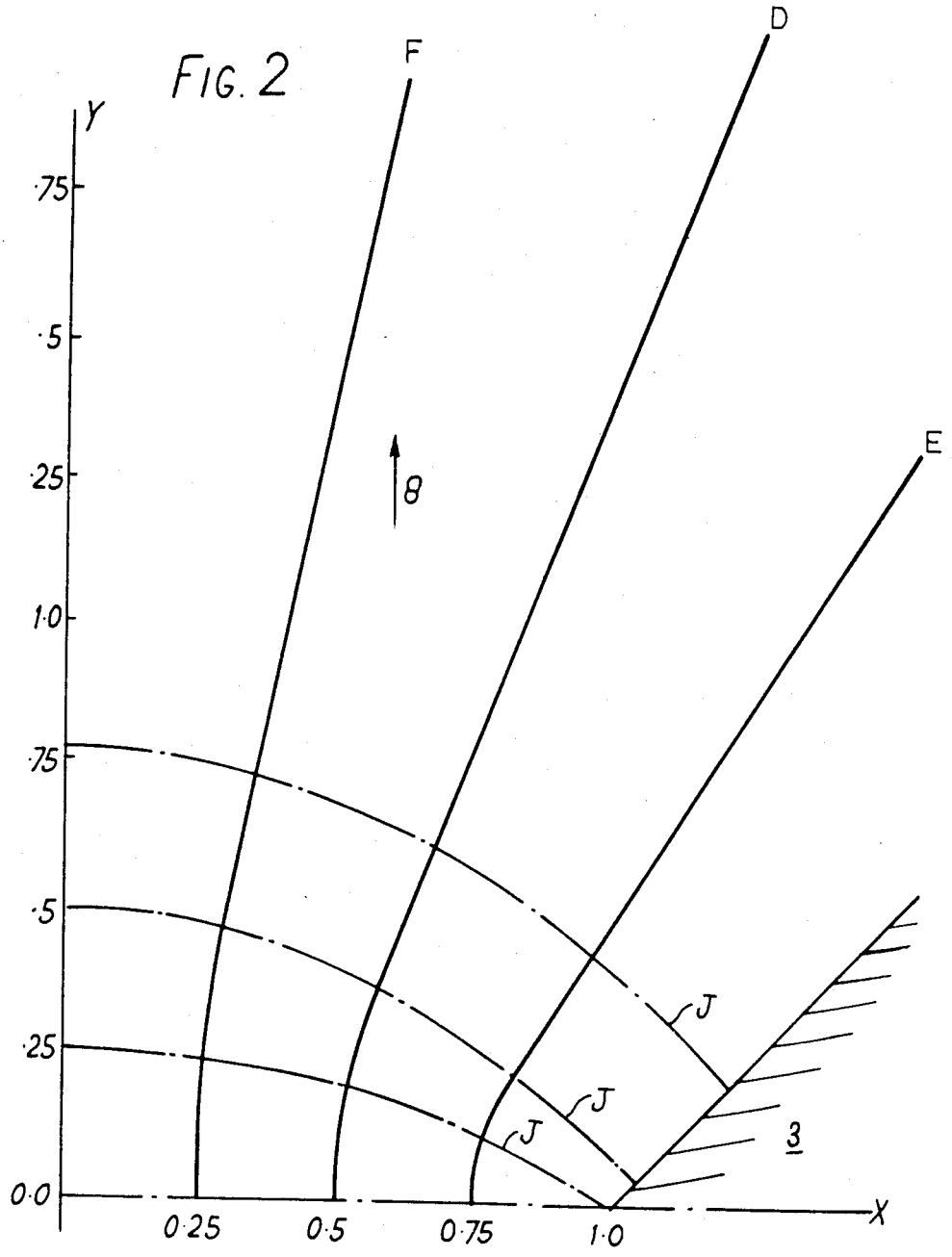
FIG. 2 is a diagram showing the isopotential lines of the electric field in a construction as shown in FIG. 1.
Figure 9:
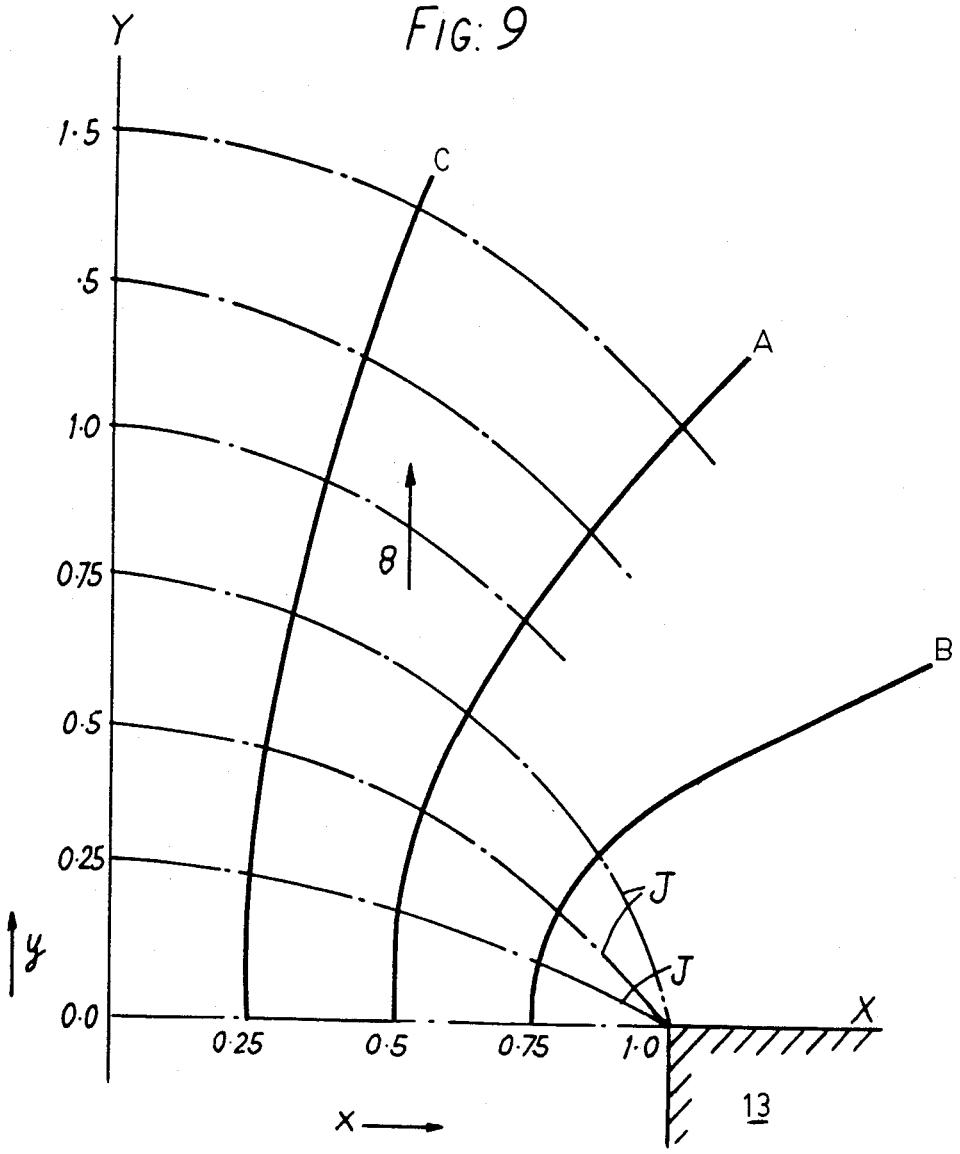
FIG. 9 is a diagram showing the isopotential lines in the electric field of the construction shown in FIG. 8.

FIGS. 10, 11, and 12, show electrode arrangements and configurations according to the present invention and which have an electric field of the kind shown in FIG. 9;

FIG. 13 shows an electrode configuration also according to the invention with an electric field consituting a combination of those shown in FIGS. 2 and 9 and in which the field axes are skewed.

Figure 15:
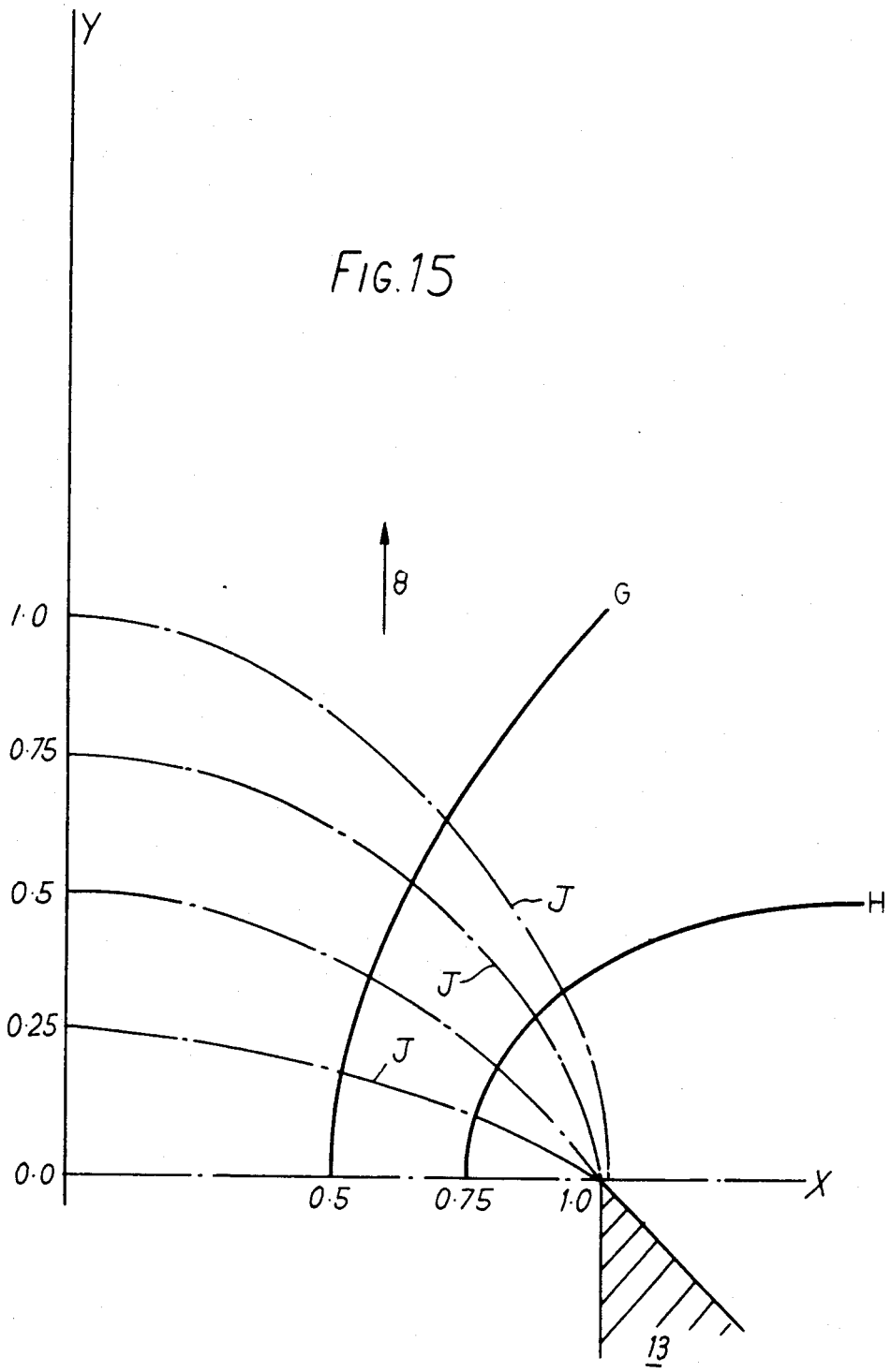

FIG. 11 shows another electrode configuration which produces another kind of electric field;

FIG. 15 is a diagram showing the electrical field and isopotential lines of the construction shown in FIG. 14;

FIG. 16 shows another electrode arrangement according to the invention;

FIGS. 17, 18 and 19 are a side view, end view and plan view respectively of apparatus according to the invention;

FIGS. 20, 21 and 22 are a side view, cross-sectional end view and plan view respectively of another construction according to the invention;

FIGS. 23, and 24 are isometric views are of a modified form of the apparatus shown in FIGS. 20, 21 and 22;

FIG. 25 is a side elevation of the apparatus shown in FIG. 24.

Figure 26:
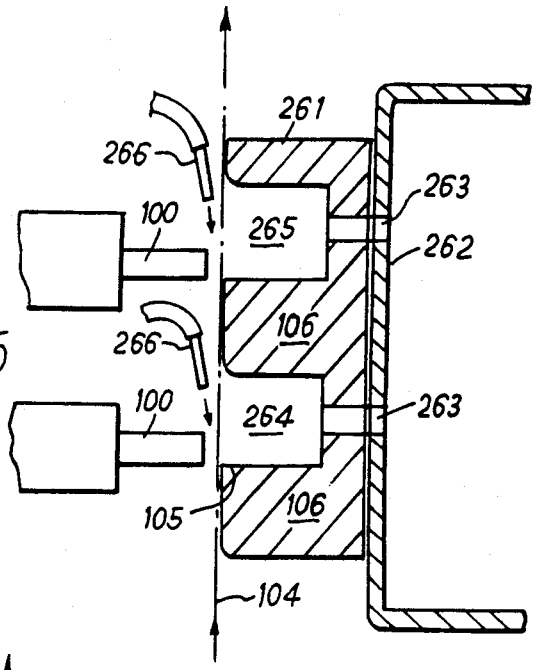
Figure 27:
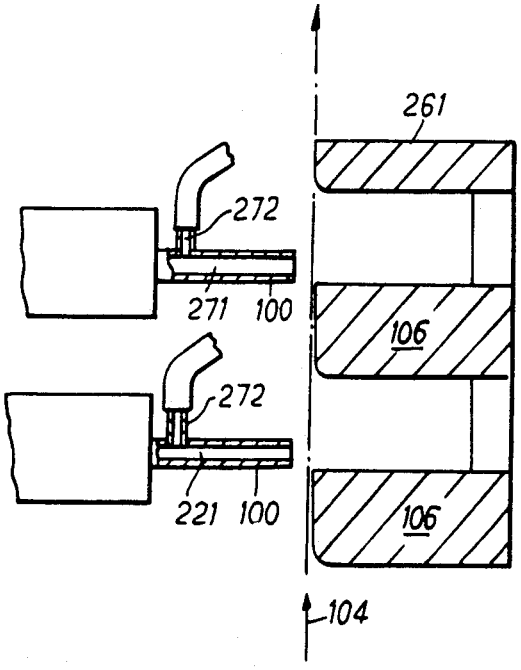
Figure 28:
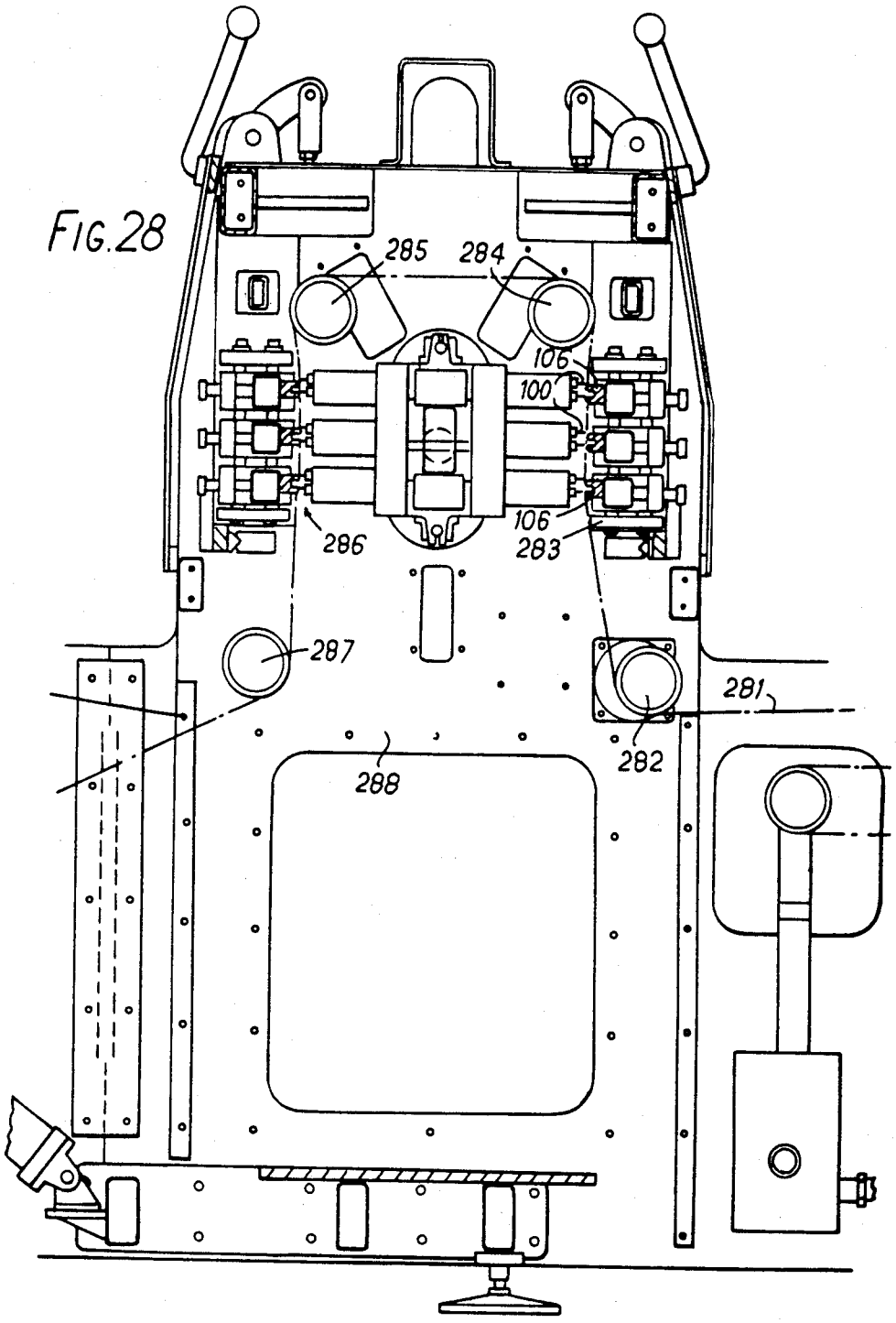

FIG. 26 is a sectional side elevation of another construction similar to that shown in FIGS. 17, 18 and 19;

FIG. 27 is a sectional side elevation of an alternative construction; and,

FIG. 28 is a side elevation of spark electrode apparatus incorporating the invention.

It has been found that the shape and position of the electrodes in spark perforation apparatus will determine the stress gradient existing in the gap between the electrodes and the mechanism of spark control can be investigated by studying the isopotentials existing in the electric field set up between differing electrode geometries.

Figure 1:
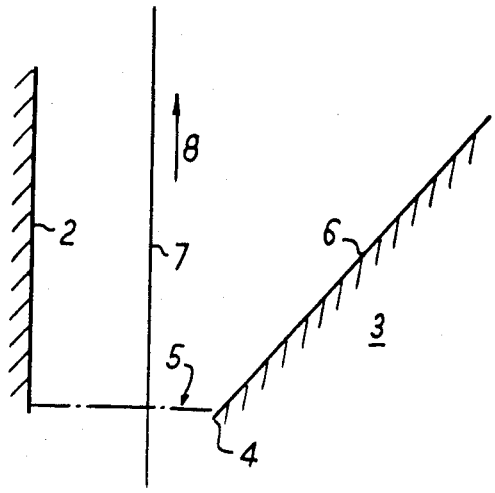
FIG. 1 is a diagrammatic view of a pair of electrodes arranged in a particular configuration and of a predetermined shape.

In the arrangement shown in FIG. 1 the first electrode 1 is in the form of a flat plane or surface indicated by reference numeral 2 and the second electrode 3 has a point 4 which provides the nearest portion of the second electrode to a first electrode 1. The minimum gap between the electrodes is indicated by broken line 5 and is formed between the nearest portion of the first electrode and the nearest portion of the second electrode. In this type of construction the electric field is thus contained within a perpendicular flat plane formed by the surface 2 and a 45° inclined plane formed by the side surface 6 of the second electrode 3, this plane terminating in the minimum gap 5. The sheet to be perforated is indicated by reference numeral 7, the spark passing between the electrodes and making an aperture in the sheet at the minimum gap 5 as described below. The direction of movement of the sheet through the gap 5 is indicated by arrow 8.

The isopotentials existing in this type of field can be calculated geometrically by defining in each case the equipotential existing at a point between the two surfaces. This is obtained by projecting vectors at right angles from each surface or point so that the modulii are equal. To a first order approximation these intercepting vectors define an equipotential point.

As shown in FIG. 2 the surface 2 of the electrode 1 is indicated by the axis line y and the gap 5 by the axis line x. The field is constructed by first obtaining the equipotentials between the two electrodes 1 and 3 to form the isopotential curve which is indicated in FIG. 2 by reference letter D. Having obtained this curve the isopotential curve D becomes in effect a boundary or shell, and may be treated as a new electrode surface. Thus equipotentials between this boundary and the electrode boundaries 1 and 2 give rise to isopotential curves E and F. The lines of electro-static force which, at all points, are at right angles to the isopotentials are indicated by chain lines J. The electric arc in space is maintained at a potential gradient and hence is at right angles to the isopotentials. This corresponds to the shape of an electrostatic force line and the arc shape will thus correspond. In considering the formation of an electric arc through the sheet 7 it is assumed that the arc will commence along the line of maximum stress, that is, the line joining points 0.0 and 1.0 on the x axis. This line is of course formed between the surface 2 on the electrode 1 and the point 4 on electrode 3. The hole thus formed in the sheet moves out of the gap 5 in the direction of movement of the sheet as indicated by arrow 8, taking the arc along with it. Hence the arc assumes the shape of the lines of force as it is pulled from the gap 5 by the hole. When the arc length becomes critical, the arc will extinguish and a new arc will be struck at the maximum stress point, which is the minimum gap 5, so as to produce a new hole spaced apart from the previous hole For a given applied voltage, by way of illustration the critical arc length for extinction may be taken as an electrical arc terminating at point 0.75 on the Y axis. It will be seen that this constitutes a minimum holes spacing equal to this Y dimension because a new hole can immediately commence at point 0.0. It will be seen, and is a feature of this invention, that for the same extinguishing arc, if the sheet plane was moved towards the pointed electrode 3 a smaller Y distance is moved as will be clear from consideration of the appropriate line J indicating the electro-static force. Thus, movement from (0.8, 0) to (0.8, 0.6) if the sheet is located at 0.8 on the X axis it need only be moved to 0.6 on the Y axis and will give a hole spacing of 0,6 as against 0.75 when moving from 0.0 on the X axis.

Typically the gap between the electrodes is between 0.2 and 1.0 mm.

The gap width will be dependent upon the paper thickness, the applied voltage and the hole spacing required. If the gap is made larger, the applied voltage must be increased to suit. This results in changing the gap width to paper thickness ratio, the field shape is unchanged. With a large gap the point (0.0, 0.75) represents a large distance, and with a small gap this distance is reduced. Hence a small gap is more desirable but imposes high constraint upon paper control and gap adjustment. In practice it is desirable to have a gap of not less than 0.3 mm when employing many electrodes.

Figure 3:
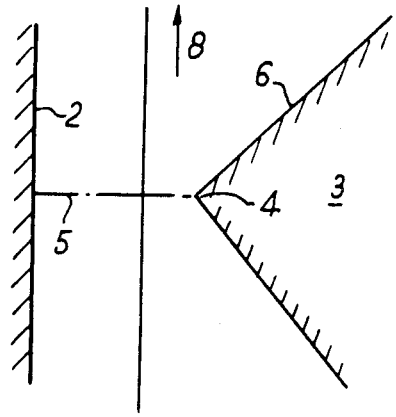
FIGS. 3, 4, 5, 6 and 7 show alternative configurations which produce electric fields of a similar kind to the construction shown in FIG. 1.
Figure 4:
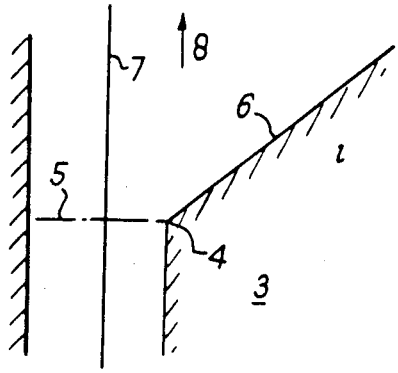
Figure 5:
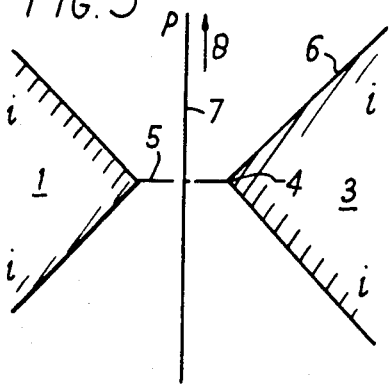
Figure 6:
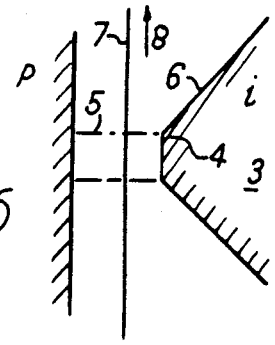
Figure 7:
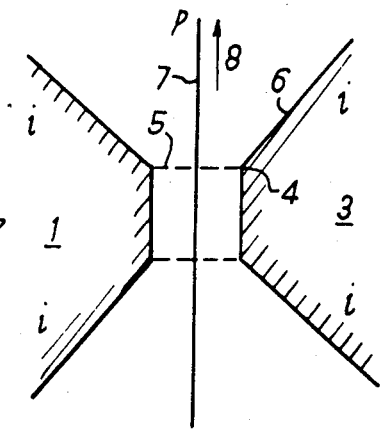

FIGS. 3, 4 and 5 show similar electrode arrangements with slightly different electrode configurations and the same reference numerals are used to indicate similar parts. In all these constructions this first type of field is produced. Again, in FIGS. 6 and 7 a similar type of field is produced but in this case the space between the flat end of the electrode 1 and the second electrode produces a uniform field.

Figure 8:
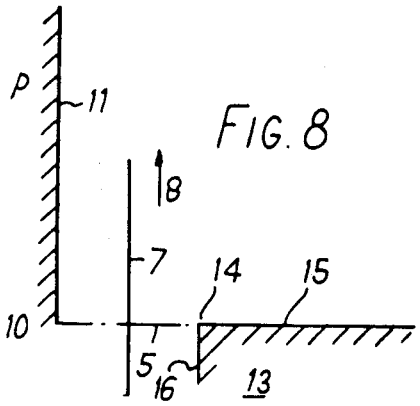
FIG. 8 shows another electrode arrangement which produces a different kind of electric field.

FIG. 8 shows another form of electrode arrangement in which the pointed second electrode 3 is replaced by an electrode with a substantially straight side and flat end. In this construction the first electrode is indicated by reference numeral 10 and has a surface 11 which extends in the direction of movement of the sheet 7, this direction again being indicated by an arrow 8. The nearest point of the second electrode 13 is in the form of a corner 14, this corner being formed between the side edge or surface indicated by reference numeral 15 and an end surface or edge 16.

FIG. 9 is a diagram similar to FIG. 2 but showing the isopotentials for the kind of construction shown in FIG. 8. The same reference numerals are used for similar parts. In this construction however curves A, B and C replace curves D, E and F. In comparing the fields shown in FIGS. 2 and 9 it will be seen that the curvature of the isopotentials increases towards the corner 14 and the lines of electro-static force 10 are therefore more curved also. It will be seen that if the sheet is located in the gap 5 adjacent the second electrode 13 then the interception with the critical arc extension length is reduced when compared with the distance of that of FIG. 2. Thus it is a feature that shaping the field to that of the kind shown in FIG. 9 and moving the paper web position in the gap 5 towards the right had side of the gap towards the second electrode 13 provides a shorter web path movement from the originating arc to the limiting extinguishing arc and hence a shorter hole pitch. Moreover, as the second electrode can be made with a substantially flat end, it permits the paper web to actually run in contact with it or very closely adjacent thereto.

Although not shown in FIG. 8 it will be clear that it is necessary to cause the spark to commence at a predetermined location in the spark gap 5 so that it is therefore necessary to have a point on the first electrode from which the spark will originate. FIGS. 10, 11, and 12, show various constructions which can be used to produce this second type of field and the same parts are indicated by similar reference numerals. In FIG. 13 electrode 10 has an offset for the direction of movement of the sheet and has a field which reduces progressively towards that of the type shown in FIG. 2. This arrangement does not use a FIG. 2 type field to the best advantage in that the paper passes obliquely through the field. Thus, FIG. 10 shows a construction according to the invention in which the electrodes are in the form of two flat ended pins, the nearest point in each electrode to the other being in the form of a corner, the first electrode 10 therefore has side surface 17, and end surface 11 extending in the direction of movement of the sheet 7 away from a corner 18 and the second electrode 13 has its side surface 15 corner 14 and end surface 16 extending away from the corner in the opposite direction to the movement of the sheet 7. The corners are arranged in alignment across the direction of movement of the sheet.

FIG. 11 shows a similar construction but in this arrangment the second electrode 13 is in the form of a bar having an extended edge 16 the end 18 of which is chamferred to assist the guidance of the sheet 7.

Tolerances of overlap and offset are permissable and in the arrangement shown in FIG. 12 the electrodes are arranged to overlap so that the first electrode 10 overlaps the second electrode in an upstream direction. It has been found that an overlap of the nearest points of the electrodes of 1 mm can be tolerated.

FIG. 13 shows an arrangement in which the corner 18 on the first electrode is arranged in an offset position downstream of the corner of 14 and it has been found that an offset spacing between the electrodes in the direction of paper movement of 1 mm can be tolerated. In this construction however this spark gap will be slightly lengthened.

It will be appreciated that this second type of field gives the advantage of greater field curvature with the facility to use a long bar, as shown in FIGS. 11, 12 and 13 over which the paper can run and with which the first electrode, in the form of a pin can strike an arc, thus maintaining the web in the zone of greatest field curvature. The preferable construction is that shown in FIG. 11 and this configuration tends to confine the originating arc between the corners and prevents pre-arcing in the uniform field zone which is caused in the overlap area of the construction shown in FIG. 12. Yet a further advantage of this type of construction is that both the pin and the bar which form electrodes can be massive compared to a pointed electrode so that heat is rapidly conducted away and erosion very substantially reduced. Further life can be obtained by very slowly oscillating either the bar or pins vertically to the plane of the figure whilst the perforator is running so that erosion takes place evenly. Appropriate mechanisms of well known kind can be provided for effecting oscillation.

It will also be appreciated that the surfaces shown in FIGS. 8, 9, 10, 11, 12 and 13 can be replaced by edges.

It has also been found that a configuration as shown in FIG. 14 provides advantages as defined by the invention. Similar reference numerals are used in this Figure to that of FIG. 8 but it will immediately be seen that the side edge 15 of the second electrode 13 is cut back to provide a corner 14 having a chisel edge configuration. FIG. 15 is a similar type of diagram to FIGS. 2 and 9 and shown the isopotential lines G and H and lines of electro-static force J. In the arrangement shown the undercut on the side surface 15 is 45°. The greater curvature of the isopotentials in the first quadrant influences the lines of force J and for limiting arc extinction lengths greater than those terminating at 0-0.75, therefore this chisel edge affords some improvement. A disadvantage however is that the chisel edge is of smaller mass and is subject to greater electrical stress. This leads toward rapid erosion of the kind experienced with needle point electrodes. However, by forming this electrode as a bar conductivity will assist cooling. In a preferred form the bar will have the cutaway angle limited to about 20°.

FIG. 16 shows an electrode structure according to the invention which can be used to produce this type of field and the same parts are indicated by similar reference numerals. It has also been found that the corners which are adjacent each other on the electrodes can have enclosing angles which, in the case of the first electrode can be between approximately 60° and 120° but which are particularly beneficial if the angle is between 80° and 95° as this gives a heavier construction. The enclosed angles at the corner of the second electrode can be between 45° and 120° and are preferably between 80° and 95° to provide the heavier construction.

FIGS. 17, 18 and 19 show an arrangement in which a series of first electrodes 100 are provided which are in the form of vertically extending cylindrical pins. The lower surface 101 of each pin is substantially horizontal and forms a corner 103 with the side surface 102. This corner 103 is aligned across the direction of movement of the paper sheet 104 which is to be perforated with the edge corner 105 of a horizontally extending bar 106 which acts as the second electrode. It will be seen that the bar will act as a support for the paper sheet to guide it through the gap between the electrodes.

In an endeavour to obtain very high porosities without largely increasing the hole size the number of holes in the unit area must be increased. The arrangement shown in FIGS. 17, 18 and 19 demonstrates how this may be obtained in the direction of paper sheet flow.

Increasing the number of holes by increasing the number of electrode pins is limited, not by the electrode size, as these electrodes may be staggered along the direction of paper flow, but by the incidence of adjacent rows of holes causing the spark to be directed to these holes in preference to creating new ones. More precise control of the spark can be achieved by creating a diverging electric field of the type described with regard to FIG. 1 but only in the cross machine direction. This can be achieved in the construction shown in FIGS. 20, 21 and 22. In this arrangement the first electrode is again in the form of a pin but the second electrode is in the form of a bar extending horizontally in the direction of movement of the sheet 104. The upper side of the bar has a pointed ridge which has an apex 207. This therefore causes a transverse field between the electrodes which is similar to the kind shown in FIG. 1 of the drawings. FIG. 23 shows how ridged bars of this type can be provided on a transversely extending support bar and the paper sheet will thus be supported on the apexes. In practice these small ridged bars are attached to a bar to provide electrical connection and have a pitch on the leading edge to prevent damage.

If required the ridged portion may be made separately and screwed to a support bar for ease of constructional replacement.

As shown in FIGS. 24 and 25 a lead on bar 301 may be incorporated to improve paper control.

In order to assist in removing debris from the holes made by the sparks a vacuum can be provided downstream of the second electrode and this vacuum will also assist to hold the paper down onto the electrode itself.

The invention can be applied to any spark electrode apparatus which can be used, for example, for increasing porosity of a sheet such as paper or plastics materials, one example of such use being spark electrode apparatus for increasing the porosity of cigarette tissue.

The invention also therefore includes a perforated sheet which has had holes made in it by apparatus according to the present invention.

FIG. 26 shows a construction similar to that shown in FIGS. 17 and 19 but employing two sets of rows of pins 100. The same reference numerals are used to indicate similar parts as FIGS. 17, 18 and 19 and it will be seen that an additional support bar 261 is provided. In order to assist in removing debris from the holes made by the sparks a vacuum is provided in a vacuum chamber 262 which thus sucks air through openings 263. These openings open respectively into a gap 264 between the two second electrodes 1 and 6 and a gap 265 between second electrode 106 and end support 261. This vacuum therefore also assists in holding the paper down onto the second electrodes. In an alternative construction (not shown) the opening 263 leading into gap 265 can be omitted as can the end support 261.

If desired air jets 266 can also be provided to assist in removing debris.

FIG. 27 shows a similar construction and the same reference numerals are used to indicate similar parts but in this construction the pins 100 have an internal bore 271 to which pressurized air is supplied through an inlet 272. Thus, the pins themselves can provide the air jets and, at the same time, the air flow will assist in cooling the pins. It will be seen that in FIGS. 26 and 27 the direction of movement of the sheet is substantially vertically upwards and not horizontal as shown in FIGS. 17, 18 and 19.

FIG. 28 shows spark perforation apparatus incorporating the invention and in this construction the layout of the electrodes is similar to that shown in FIG. 26 but the end support bar 261 is omitted and no vacuum or air jets are provided. It will be appreciated that the construction of the electrodes could be as set forth in any one of the examples described above and vacuum suction and air jets could be included if desired. A sheet of material to be perforated is provided in the form of a continuous web 281 which is taken from a roll (not shown) the web 281 passes around a guide roller 282 and is then led over a lead-in bar 283 prior to passing between a first bank of three rows of electrodes 100, 106. Each row has two lines of electrodes 100, 106. The web then passes around a second guide roller 284, around a third guide roller 285 and descends vertically downwardly through a second bank of electrodes 286 which are similar to those in the first bank. From here the web passes around a fourth guide roller 287 and via a tensioning device to a take up roll (not shown).

As will be seen from the drawing the apparatus is carried in a substantial frame indicated by reference numeral 288 and appropriate electrical connections and drive means are provided.

I claim:

1. Apparatus for spark perforation of sheet material comprising spaced apart first and second electrodes which define between them a sparking zone through which sheet material to be perforated can be moved in a predetermined direction, and in which within said sparking zone, said electrodes have their closest parts substantially in a plane transverse to the direction of movement of the sheet material, one electrode extending substantially to one side of said transverse plane and the other said electrode extending substantially to the other side of said plane.

2. Apparatus as claimed in claim 1, wherein the gap between the electrodes is between 0.2 and 1.0 mm.

3. Apparatus as claimed in claim 1, wherein a portion of each electrode which is nearest to the other electrode is in the form of a corner, the corner on the first electrode being formed between a side surface or edge, and an end surface or edge extending away from the corner in the direction of movement of the sheet.

4. Apparatus as claimed in claim 3, wherein the corner on the second electrode is formed between a side surface or edge and a converging end surface or edge extending away from said corner in the opposite direction to the direction of movement of the sheet.

5. Apparatus as claimed in claim 3, wherein the enclosed angle at the corner of the first electrode between the side surface or edge and the end surface or edge is between approximately 60° and 120°.

6. Apparatus as claimed in claim 5, wherein the enclosed angle is between 80° and 95°.

7. Apparatus as claimed in claim 4, wherein the enclosed angle at the corner of the second electrode between the side surface or edge and the end surface or edge is between approximately 45° and 120°.

8. Apparatus as claimed in claim 7, wherein the enclosed angle is between 80° and 95°.

9. Apparatus as claimed in claim 8, wherein said first electrode is in the form of a pin-like member the corner being formed at its lower end.

10. Apparatus as claimed in claim 9, wherein the second electrode is formed as a bar-like member, the corner being provided at an end surface or edge at one of its long sides.

11. Apparatus as claimed in claim 1, including a plurality of sets of spaced apart electrodes.

12. Apparatus as claimed in claim 11, wherein said first electrodes are arranged in at least one row transverse to the direction of movement of the sheet.

13. Apparatus as claimed in claim 10, wherein said first electrodes are arranged in at least one row transverse to the direction of movement of the sheet.

14. Apparatus as claimed in claim 13, wherein the barlike member acts as a support bar for the sheet and extends along the length of the row.

15. Apparatus as claimed in claim 14, wherein the horizontally extending edges are formed as a series of apexed ridges on the support bar, the ridges extending in the direction of movement of the sheet towards the corner provided on each electrode.

16. Apparatus as claimed in claim 15, wherein a lead-on bar extending transverse to the direction of movement of the sheet joins the ridges and acts to guide the sheet onto the edges.

17. Apparatus as claimed in claim 1, wherein a vacuum is applied to the underside of the sheet downstream of the second electrode.

18. Apparatus as claimed in claim 1, including means for providing a jet of air at the spark gap.

19. Apparatus as claimed in claim 18, wherein the first electrode is provided with a bore through which a fluid is caused to flow under pressure to provide the jet at the spark gap.

* * * * *